US012416205B2

(12) United States Patent
Nassir

(10) Patent No.: US 12,416,205 B2
(45) Date of Patent: Sep. 16, 2025

(54) ON-DEMAND VARIABLE GAUGE PADS AND METHODS OF USE

(71) Applicant: SAUDI ARABIAN OIL COMPANY, Dhahran (SA)

(72) Inventor: Alawi G. Al Alsayed Nassir, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 123 days.

(21) Appl. No.: 18/327,497

(22) Filed: Jun. 1, 2023

(65) Prior Publication Data

US 2024/0401415 A1 Dec. 5, 2024

(51) Int. Cl.
*E21B 10/62* (2006.01)
*E21B 47/013* (2012.01)
*E21B 47/12* (2012.01)

(52) U.S. Cl.
CPC ..... *E21B 10/62* (2013.01); *E21B 47/013* (2020.05); *E21B 47/12* (2013.01)

(58) Field of Classification Search
CPC ..... E21B 10/62
See application file for complete search history.

(56) References Cited

U.S. PATENT DOCUMENTS 3,326,308 A * 6/1967 White ..... E21B 10/627 175/413
3,463,256 A * 8/1969 White ..... E21B 10/627 175/412
3,760,894 A * 9/1973 Pitifer ..... E21B 10/633 175/413
4,838,366 A * 6/1989 Jones ..... E21B 10/42 175/413
5,439,068 A * 8/1995 Huffstutler ..... E21B 10/24 175/227
5,560,440 A 10/1996 Tibbitts
6,260,636 B1 * 7/2001 Cooley ..... E21B 10/00 175/73
10,415,320 B2 9/2019 Savage
11,591,857 B2 * 2/2023 Zhang ..... E21B 10/46
2006/0065395 A1 * 3/2006 Snell ..... E21B 41/0078 175/45
2015/0218940 A1 * 8/2015 Pelletier ..... E21B 49/005 175/41
2017/0253788 A1 * 9/2017 Ivanov ..... E21B 33/13
2018/0229467 A1 * 8/2018 Walker ..... E21B 4/003
(Continued)

FOREIGN PATENT DOCUMENTS

EP 1163420 B1 9/2004

*Primary Examiner* — Blake Michener
(74) *Attorney, Agent, or Firm* — Vorys, Sater, Seymour and Pease LLP

(57) ABSTRACT

A method of drilling a wellbore includes rotating a drill bit positioned at a distal end of a drill string and thereby drilling a portion of the wellbore, the drill bit including a bit body and one or more variable gauge pads removably coupled to the bit body, retrieving the drill bit to a well surface at a well site and removing a used variable gauge pad of the one or more variable gauge pads from the bit body at the well site, coupling a new variable gauge pad to the bit body in place of the used variable gauge pad, and extending the drill bit with the new variable gauge pad back into the wellbore and resuming drilling operations with the drill bit.

20 Claims, 7 Drawing Sheets

(56) References Cited

U.S. PATENT DOCUMENTS

| | | | | |
|---|---|---|---|---|
| 2018/0371843 | A1* | 12/2018 | Savage | B23K 1/008 |
| 2019/0271227 | A1* | 9/2019 | Peters | E21B 47/024 |
| 2020/0378190 | A1* | 12/2020 | Grosz | E21B 10/54 |
| 2021/0388679 | A1* | 12/2021 | Marshall | E21B 10/322 |

* cited by examiner

ON-DEMAND VARIABLE GAUGE PADS AND METHODS OF USE

FIELD OF THE DISCLOSURE

The present disclosure relates generally to drill bits used to drill wellbores in the oil and gas industry and, more particularly, to wellbore drill bits that include variable gauge pads.

BACKGROUND OF THE DISCLOSURE

In the oil and gas industry, drill bits are commonly used to drill wellbores or boreholes. To accomplish this, a drill bit is attached to the end of a string of drill pipe (i.e., a "drill string") and rotated to grind and cut through the underlying rock and subterranean formations of the earth.

Conventional drill bits often times include gauge pads on the exterior, outer radial surfaces of the drill bit body to help define the diameter and smoothness of the borehole and improve stability of the drill bit. During drilling operations, stresses placed on the gauge pads by the rock and subterranean formations, as well as debris, may wear or damage the gauge pads. As the gauge pads become worn or damaged, the drill bit may lose stability, which may lead to drifting of the drilling direction. Further, as the gauge pads wear, the gauge diameter of the borehole correspondingly decreases and fails to match the desired or planned diameter, thus resulting in an "undergauge" condition. The wear or damage to the gauge pads may occur unnoticed until the drill bit begins drifting off course or undergauging the borehole, which may require further corrective measures downhole in addition to assessing the damage to the drill bit.

For conventional drill bits, wear or damage on gauge pads may require a drill bit to be tripped out of the hole and repaired. In some cases, the drill bit may be considered damaged beyond repair due to the damage incurred on the gauge pads, and the entire drill bit must be replaced regardless of the durability of the remainder of the drill bit. Further, some drilling operations may require a varied drilling strategy calling for varying gauge pad configurations or compositions, such that replacement of undamaged drill bits with drill bits possessing desirable gauge pads may be necessary during these operations.

Accordingly, variable gauge pads are desirable which may be replaced with replacement or reconfigured variable gauge pads while on-site.

SUMMARY OF THE DISCLOSURE

Various details of the present disclosure are hereinafter summarized to provide a basic understanding. This summary is not an exhaustive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a method of drilling a wellbore includes rotating a drill bit positioned at a distal end of a drill string and thereby drilling a portion of the wellbore, the drill bit including a bit body and one or more variable gauge pads removably coupled to the bit body, retrieving the drill bit to a well surface at a well site and removing a used variable gauge pad of the one or more variable gauge pads from the bit body at the well site, coupling a new variable gauge pad to the bit body in place of the used variable gauge pad, and extending the drill bit with the new variable gauge pad back into the wellbore and resuming drilling operations with the drill bit.

In another embodiment, a drilling system includes a drilling rig, a drill string extending from the drilling rig and into a wellbore, a drill bit arranged at a distal end of the drill string and including a bit body that defines pocket on an outer radial portion of the bit body, and a variable gauge pad sized to be received within the pocket and removably coupled to the bit body. The variable gauge pad includes a solid body providing a gauge pad surface oriented away from the bit body when coupled to the bit body, and a mating mechanism for removably coupling the solid body to the bit body at the pocket.

In a further embodiment, a drill bit includes a bit body, and one or more variable gauge pads removably coupled to an outer radial portion of the bit body. Each variable gauge pad includes a solid body providing a gauge pad surface oriented away from the bit body when coupled to the bit body, a mating mechanism provided on a surface opposite the gauge pad surface and configured to removably couple the solid body to the bit body, a pocket defined in a backside of the solid body, and one or more sensors mounted in the pocket and operable to obtain real-time readings and data of the variable gauge pad during drilling, wherein the one or more sensors are communicable with a well operator during drilling to convey the readings and data in real time to an operator.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
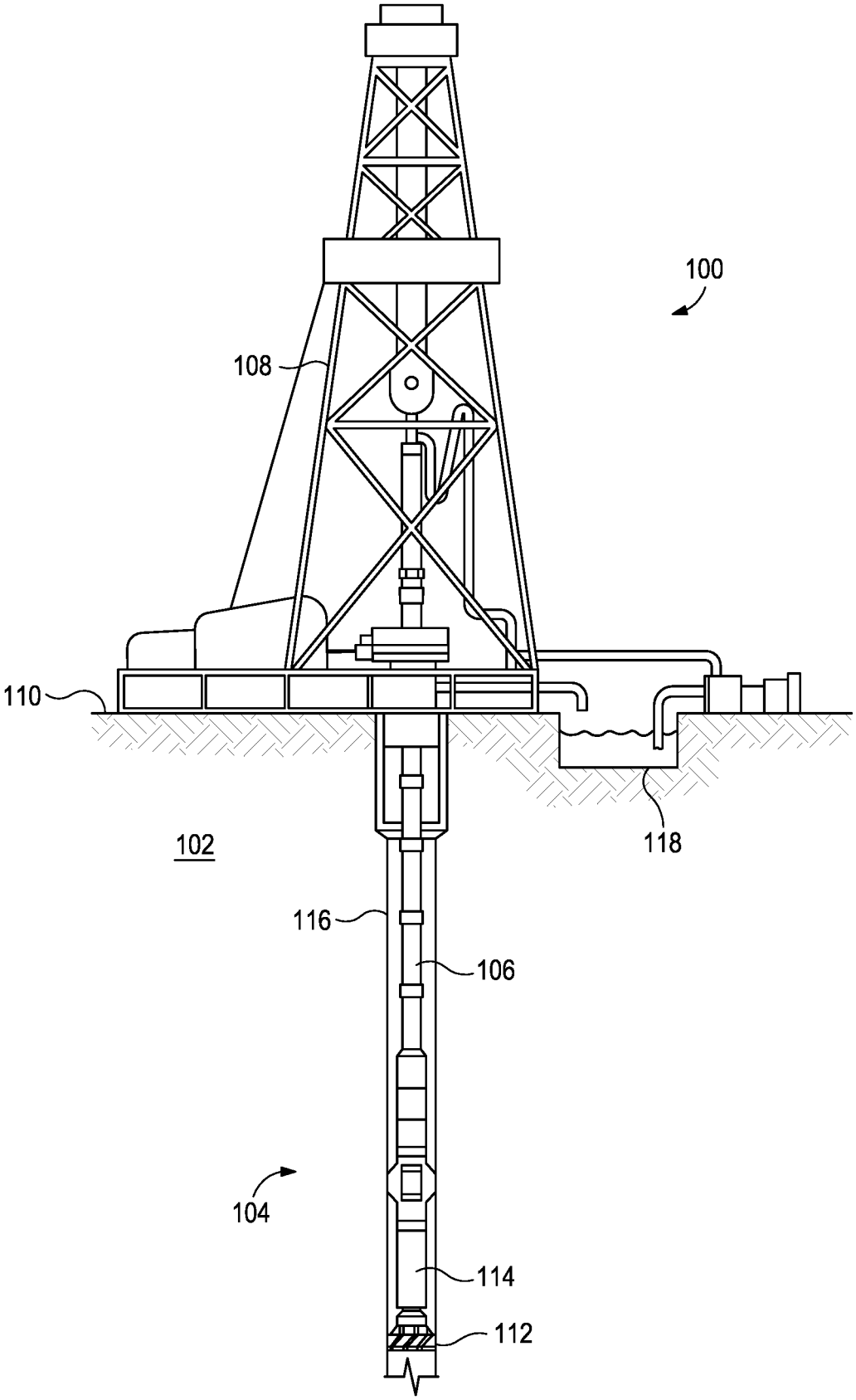
FIG. 1 is a schematic diagram of an example drilling system that may employ one or more principles of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to drill bits used to drill wellbores in the oil and gas industry and, more particularly, to wellbore drill bits that include variable gauge pads. Embodiments described herein may include variable gauge pads which may be designed and manufactured for varying lengths and thicknesses, and also made of a variety of materials. The variable gauge pads may include cutting elements or hardfacing materials for additional cutting and smoothing operations, and may be mated with drill bits via complementary mating mechanisms.

In some embodiments, the variable gauge pads may include one or more sensors embedded within the solid body of a "smart" variable gauge pad. Such smart variable gauge pads may communicate with surface operator equipment for determining real-time drilling parameters and monitoring real-time damage to the gauge pads. Embodiments described herein may further include methods of design and manufacture of variable gauge pads, including additive manufacturing of variable gauge pads at a drill site during repair or replacement operations. The embodiments disclosed herein may reduce replacement and repair costs of fixed cutter drill bits, enable active downhole monitoring of drill bit and variable gauge pad health, and enable active redesign and replacement of variable gauge pads on-site.

FIG. 1 is a schematic diagram of an example drilling system 100 that may incorporate one or more principles of the present disclosure. Boreholes may be created by drilling into the earth 102 using the drilling system 100. To accomplish this, the drilling system 100 may be configured to drive a bottom hole assembly (BHA) 104 positioned or otherwise arranged at the bottom of a drill string 106 extended into the earth 102 from a drilling rig or "derrick" 108 arranged at the well surface 110. The drilling rig 108 includes various mechanisms operable to lower and raise the drill string 106.

The BHA 104 includes a drill bit 112 operatively coupled to a tool string 114 which is moved axially within a drilled wellbore 116 as attached to the drill string 106. The depth (length) of the wellbore 116 is extended by rotating the drill bit 112, which grinds and cuts through the underlying rock and subterranean formations of the earth 102. During drilling operations, a drilling fluid or "mud" from a mud tank 118 may be pumped into the drill string 106 and conveyed downhole to the drill bit 112. Upon reaching the drill bit 112, the mud is discharged through various nozzles included in the drill bit 112 to cool and lubricate the drill bit 112. The mud then circulates back to the surface 110 via the annulus defined between the wellbore 116 and the drill string 106, and in the process returns drill cuttings and debris to the surface. The cuttings and mud mixture are processed and returned to the mud tank 118 to be subsequently conveyed downhole once again.

Figure 2:
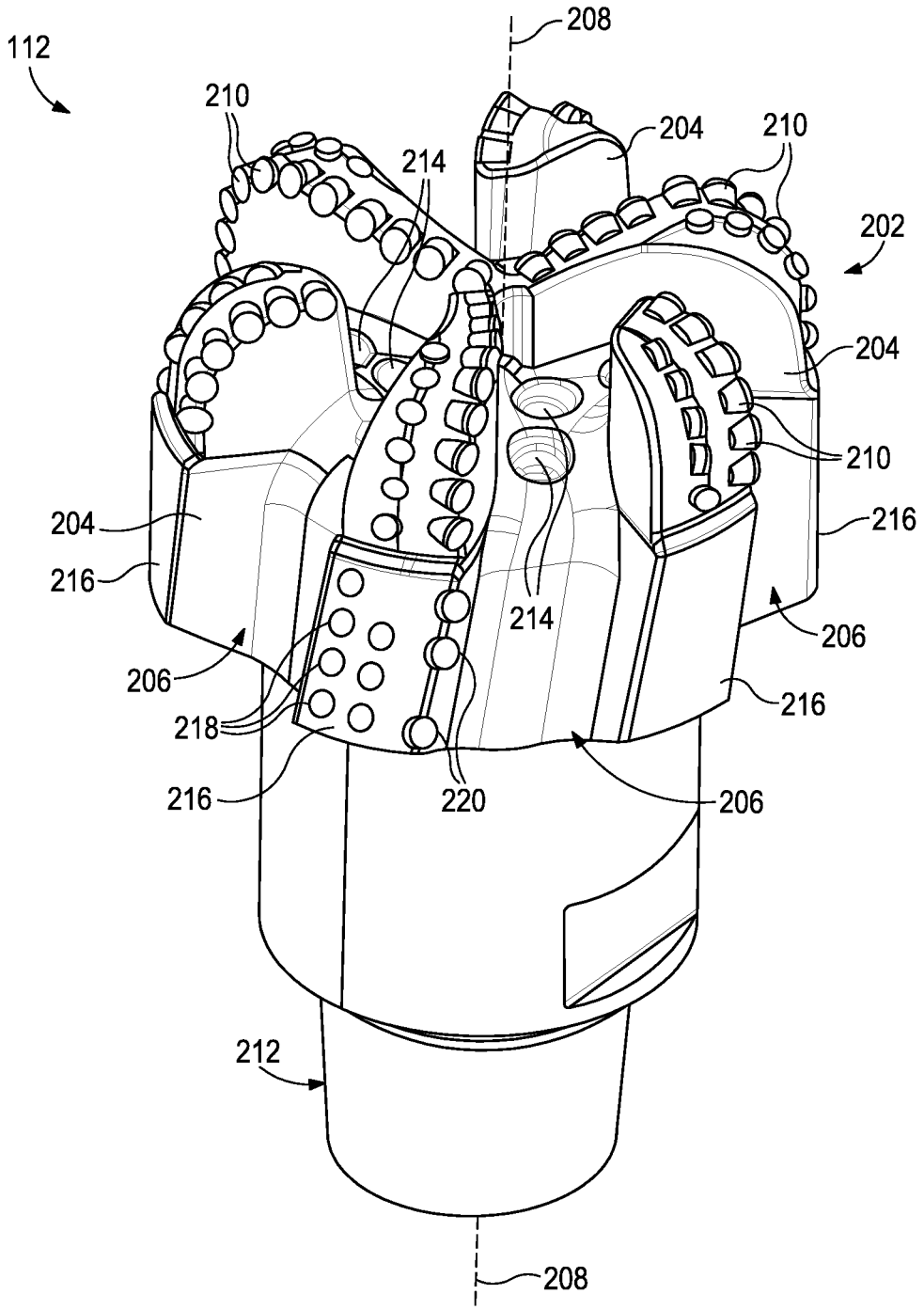
FIG. 2 is an isometric top view of a prior art drill bit.

FIG. 2 is an isometric view of an example drill bit 112 that may incorporate the principles of the present disclosure. In the illustrated embodiment, the drill bit 112 is a rotary drill bit, but the principles of the present disclosure are equally applicable to other drill bit configurations, such as roller cone drill bits. Accordingly, the term "rotary drill bit" refers to various types of fixed cutter drill bits, drag bits, matrix drill bits, impregnated drill bits, core head bits, hybrid drill bits, steel body drill bits, roller cone drill bits, rotary cone drill bits, and rock bits operable to form a wellbore. As will be appreciated, rotary drill bits and associated components incorporating the teachings of the present disclosure may have many different designs, configurations, and/or dimensions.

As illustrated, the drill bit 112 includes a generally cylindrical bit body 202 that provides or otherwise defines one or more drill bit blades 204 separated by junk slots 206. The blades 204 may be provided in a wide variety of configurations including, but not limited to, substantially arched, helical, spiraling, tapered, converging, diverging, symmetrical, asymmetrical, or any combination thereof. In the illustrated embodiment, some of the blades 204 extend to a centerline 208 of the bit body 202 and may be referred to as "primary" blades, while other blades 204, referred to as "secondary" blades, do not extend to the centerline 208 and operate to "follow" the primary blades 204 during operation.

The bit body 202 can be formed integrally with the blades 204, such as being milled out of a steel blank. Alternatively, the blades 204 can be welded to the bit body 202. In other embodiments, the bit body 202 and the blades 204 may be formed of a matrix material (e.g., tungsten carbide matrix with an alloy binder) sintered and/or cast in a mold of a desired shape, with the blades 104 also being integrally formed of the matrix with the bit body 202.

The drill bit 112 further includes a plurality of cutting elements 210 (alternately referred to as "cutters") fixed to the blades 204. Some of the cutting elements 210 may be mounted at the leading face of some or all of the blades 204. Each cutting element 210 may be received within and bonded to a dedicated cutter pocket machined or cast into the bit body 202 at the corresponding blade 204. One or more of the cutting elements 210 may include a cutting table or face bonded to a substrate secured within a corresponding cutter pocket. The cutting table may be made of a variety of hard or ultra-hard materials such as, but not limited to, polycrystalline diamond (PCD), sintered tungsten carbide, thermally stable polycrystalline (TSP), polycrystalline boron nitride, cubic boron nitride, natural or synthetic diamond, hardened steel, or any combination thereof. The substrate may also be made of a hard material, such as tungsten carbide or a ceramic. In other embodiments, however, one or more of the cutting elements 210 may not include a cutting table. In such embodiments, the cutting elements 210 may comprise sintered tungsten carbide inserts without a cutting table and bonded to corresponding cutter pockets. The cutting elements 210 may be bonded to the corresponding blade 204 such that they are fixed or alternately allowed to rotate.

The cutting elements 210 may comprise any suitable cutter designed to cut, gouge, and/or scrape into underlying rock formations as the bit body 202 rotates during downhole operation. The cutting elements 210 can include primary cutting elements, back-up cutting elements, secondary cutting elements, or any combination thereof. In some applications, other types of cutting elements may be fixed to various portions of the primary or secondary blades 204. Such cutting elements can include, but are not limited to, cutters, compacts (e.g., polycrystalline diamond compacts or "PDC"s), and buttons suitable for use with a wide variety of drill bits. In some cases, the blades 204 may also include one or more depth of cut controllers (DOCCs) configured to control the depth of cut of the cutting elements 210. Various features may also be affixed to the blades 204 to mitigate vibration.

The drill bit 112 further includes a pin 212 that defines American Petroleum Institute (API) drill pipe threads used to releasably engage the drill bit 112 with drill pipe or a bottom-hole assembly (BHA) whereby the drill bit 112 may be rotated relative to the centerline 208. In example operation, as the drill bit 112 advances into the earth, a drilling fluid (e.g., water, drilling mud, etc.) is communicated to one or more nozzles 214 provided in the bit body 202 to cool and lubricate the drill bit 112. The drilling fluid is discharged from the nozzles 214 and into the junk slots 206, and a mixture of drilling fluid, formation cuttings, and other downhole debris flow through the junk slots 206 to be returned to the well surface via the annulus of the drilled wellbore.

Moreover, the drill bit 112 may further include one or more gauge pads 216 provided on outer radial portions of the blades 204 or the bit body 102 generally to contact radially adjacent portions of the drilled wellbore. In some embodiments, one or more of the gauge pads 216 may include one or more gauge inserts 218 and/or one or more gauge cutters 220. The gauge inserts 218 and cutters 220 are shown in FIG. 2 on only one gauge pad 216, but could alternatively be included on all gauge pads 216. The gauge inserts 218 and gauge cutters 220 may be made of any of the hard or ultra-hard materials mentioned above for the cutting elements 210, and may be secured to the gauge pad 216 by brazing, welding, mechanical fasteners, an interference fit, or any combination thereof. As illustrated, the gauge inserts 218 may be generally positioned on the outer radial face of the gauge pad 216, and the gauge cutters 220 may be positioned at the leading face of the gauge pad 216. The gauge inserts 218 may be configured to help stabilize the drill bit 122 during rotation, and the gauge cutters 220 may be operable to help maintain a predetermined diameter of the drilled wellbore and thereby enhance the ability of the drill bit to maintain a properly gauged wellbore.

During drilling operations, the gauge pads 216, including the gauge inserts and cutters 218, 220, may endure wear or damage from advancing through rock and lingering debris. The wear or damage of the gauge pads 216 may lead to an undergauge hole, where the gauge of the wellbore progressively decreases below the desired diameter as the damage to the gauge pads 216 progresses. Accordingly, the drill bit 112 may be backed out of the wellbore and assessed to determine whether or not repairs are possible to restore the drill bit 112 and the gauge pads 216.

In conventional drill bits, the gauge pads 216 form an integral part of the bit body 202. Consequently, if the gauge pads 216 are damaged beyond repair, the entire drill bit 112 may be considered damaged beyond repair and a new drill bit 112 may be necessary for continued operations. Replacing the drill bit 112 may introduce additional tooling costs and operational downtime in order to provide the new drill bit with fresh gauge pads 216 engineered to the correct bore diameter. Further, the remaining portions of the drill bit 112 may still be functional and relatively undamaged, but will oftentimes be disposed of or recycled due to worn or damaged gauge pads 216. In some embodiments, the drill bit 112 must be replaced regardless of damage or wear, as the drilling operation may require gauge pads 216 of a different gauge length or type.

Figure 3:
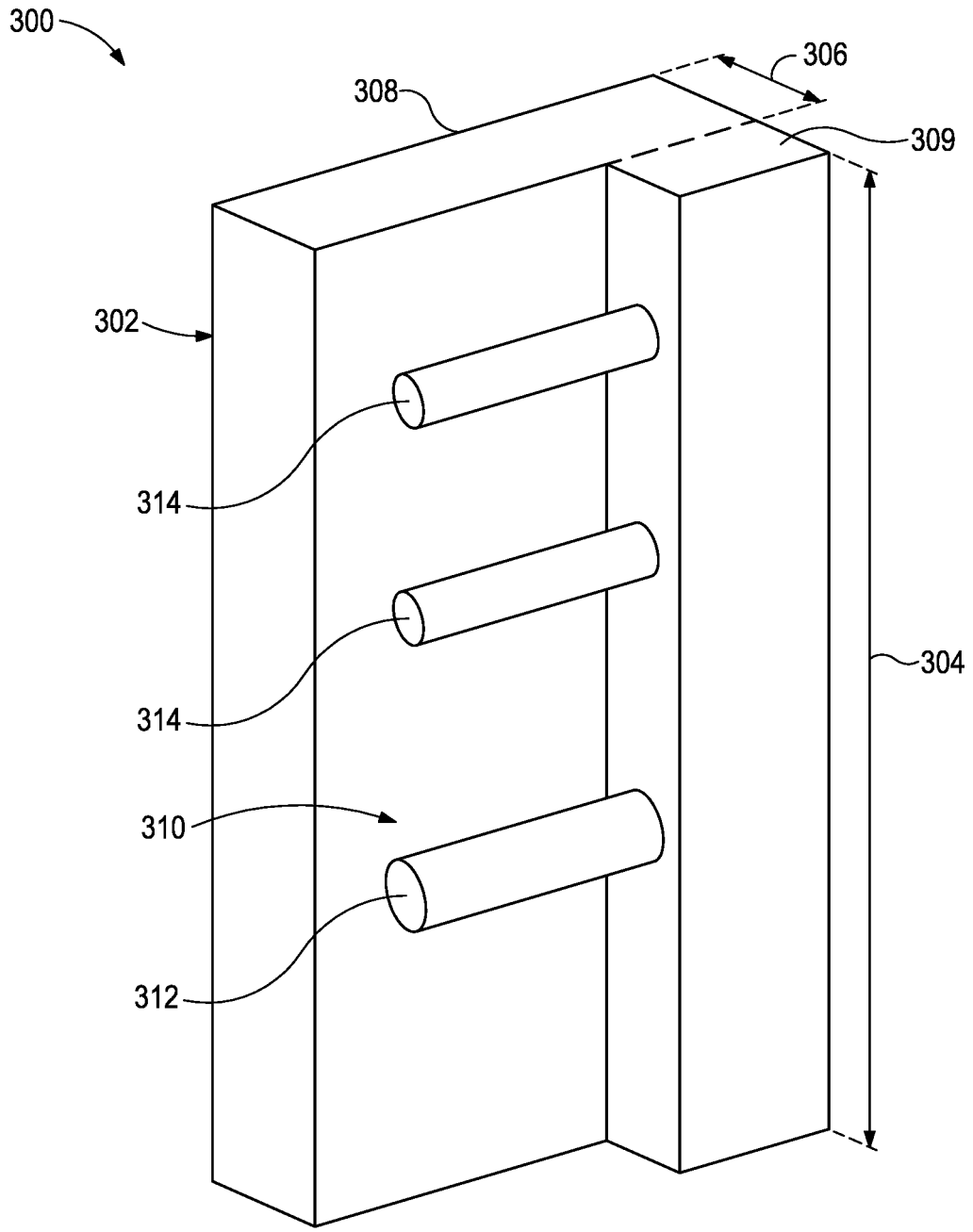
FIG. 3 is an isometric view of a variable gauge pad, according to at least one embodiment of the present disclosure.

FIG. 3 is an isometric view of an example on-demand variable gauge pad 300, according to one or more embodiments of the present disclosure. As described herein, the on-demand variable gauge pad 300 (hereafter the "variable gauge pad 300") may comprise a separate component part that can be removably attached to a bit body (e.g., the bit body 102 of FIG. 1). Consequently, the variable gauge pad 300 may be designed and engineered to meet specific drilling and borehole requirements. As used herein, the term "on-demand" refers to the ability to swap out the variable gauge pad 300 as needed at a rig site to optimize a drilling operation.

As illustrated, the variable gauge pad 300 may define or otherwise include a solid body 302 which may exhibit a specified gauge height or "length" 304 and gauge depth or "thickness" 306. The variable gauge pad 300 may also provide a gauge pad surface 308 configured to be oriented away from the bit body, thus constituting the outer radial surface of the variable gauge pad 300 that contacts and forms the inner walls of the wellbore during operation.

The gauge length 304 may be varied during design or manufacturing and based upon the desired operation or the formation composition in which drilling may be performed. In some embodiments, for example, increasing the gauge length 304 may decrease the steerability of the drill bit (e.g., the drill bit 112 of FIGS. 1 and 2), as the length of the gauge pad surface 308 is correspondingly increased. In contrast, increasing the gauge length 304 may decrease bit walk, or the undesired lateral travel of the drill bit, which may occur during the drilling operation. As such, the gauge length 304 may be specifically tuned during design of the variable gauge pad 300 such that straight-line drilling may favor a longer gauge length 304, while operations requiring frequent steering or directional changes may favor a shorter gauge length 304. The gauge thickness 306 may be directly controlled by and otherwise correspond to the desired gage (diameter) of the borehole to be drilled, such that the variable gauge pad 300 matches the desired specification.

While not visible in FIG. 3, the gauge pad surface 308 may include one or more gauge inserts 218 (FIG. 2) and/or gauge cutters 220 (FIG. 2), or may alternatively, or in addition thereto, include a variety of cutting or hardfacing surfaces. As indicated above, the variable gauge pad 300 may be removably attached to the drill bit (e.g., the drill bit 112 of FIGS. 1 and 2) such that the gauge pad surface 308 is oriented away from the drill bit during drilling operations, which allows the cutting or hardfacing surfaces carve and define the diameter of the borehole.

In some embodiments, the gauge pad surface 308 may be slotted, tapered, textured, or angled for varying effects while drilling a borehole, such as increased surface area or debris removal. In some embodiments, the solid body 302 may be formed of erosion-resistant steel or another high-strength metal, while the gauge pad surface 308 may include one or more layers of hardfacing material such as a hardfacing, thermally stable polycrystalline (TSP), tungsten, titanium, or a cobalt alloy.

The body 302 may further provide and otherwise define a radial shoulder 309 that extends radially away from the gauge pad surface 308. The radial shoulder 309 may be configured to help receive the body 302 within a pocket defined on the drill bit 112, and the pocket may provide a corresponding radial recess sized to receive and seat the radial shoulder 309.

The variable gauge pad 300 may include a mating mechanism 310 on a face or surface opposite that of the gauge pad surface 308. The mating mechanism 310 may enable the variable gauge pad 300 to be installed on or removed from a drill bit (e.g., the drill bit 112 of FIGS. 1 and 2) on-site during a drilling operation. As such, the mating mechanism 310 may include an initial means for securing the variable gauge pad 300 to the drill bit. Following the initial mating of the variable gauge pad 300 to the drill bit via the mating mechanism 310, the variable gauge pad 300 may be brazed, welded, fastened, or locked into place for use in drilling operations.

In the illustrated embodiment, the mating mechanism 310 includes a main pin 312 and one or more secondary pins 314 vertically offset from the main pin 312. The main and secondary pins 312, 314 may extend laterally from the radial shoulder 309 and generally parallel to the gauge pad surface 308. Moreover, the main and secondary pins 312, 314 may extend generally parallel to each other and may be configured to align with corresponding slots or holes defined in the drill bit 112, such as within the pocket defined in the drill bit, as briefly mentioned above. More specifically, the main pin 312 may be inserted into a corresponding slot or hole defined in the drill bit, and the one or more secondary pins 314 may provide additional mating and retention of the variable gauge pad 300, while further providing protection against angular motion of the variable gauge pad 300 after installation. In some embodiments, as illustrated, the main and secondary pins 312, 314 may exhibit a generally circular cross-section, but could alternatively exhibit other cross-sectional shapes, such as polygonal. Moreover, in some embodiments, the main and secondary pins 312, 314 may exhibit the same size or diameter, but could alternatively exhibit different sizes or diameters. Those skilled in the art will readily appreciate that the mating mechanism 310 is not limited to the illustrated embodiment, but may include any geometry corresponding to matching geometry on a bit body without departing from the scope of this disclosure.

The variable gauge pad 300 may be selectively designed and manufactured on-site (i.e., at a drill rig) and in real-time during a drilling operation by the well operator or personnel present at the drill rig. As described in more detail below, this may be accomplished by 3D printing the variable gauge pad 300. Consequently, the optimal gauge length 304, gauge thickness 306, and gauge pad surface 308 may be selected in real-time for the current drilling operation and need. The mating mechanism 310 and the corresponding mating mechanism of a drill bit may be utilized in removing, repairing, or replacing variable gauge pads 300. As will be appreciated, the ability to remove, manufacture, and replace variable gauge pads 300 on-site may reduce downtime and tooling costs while improving drilling efficiency or steerability. In at least one embodiment, a plurality of variable gauge pads 300 may be initially provided with a bit body, such that gauge pad configuration may be adjusted or reconfigured prior to use of the bit.

Figure 4:
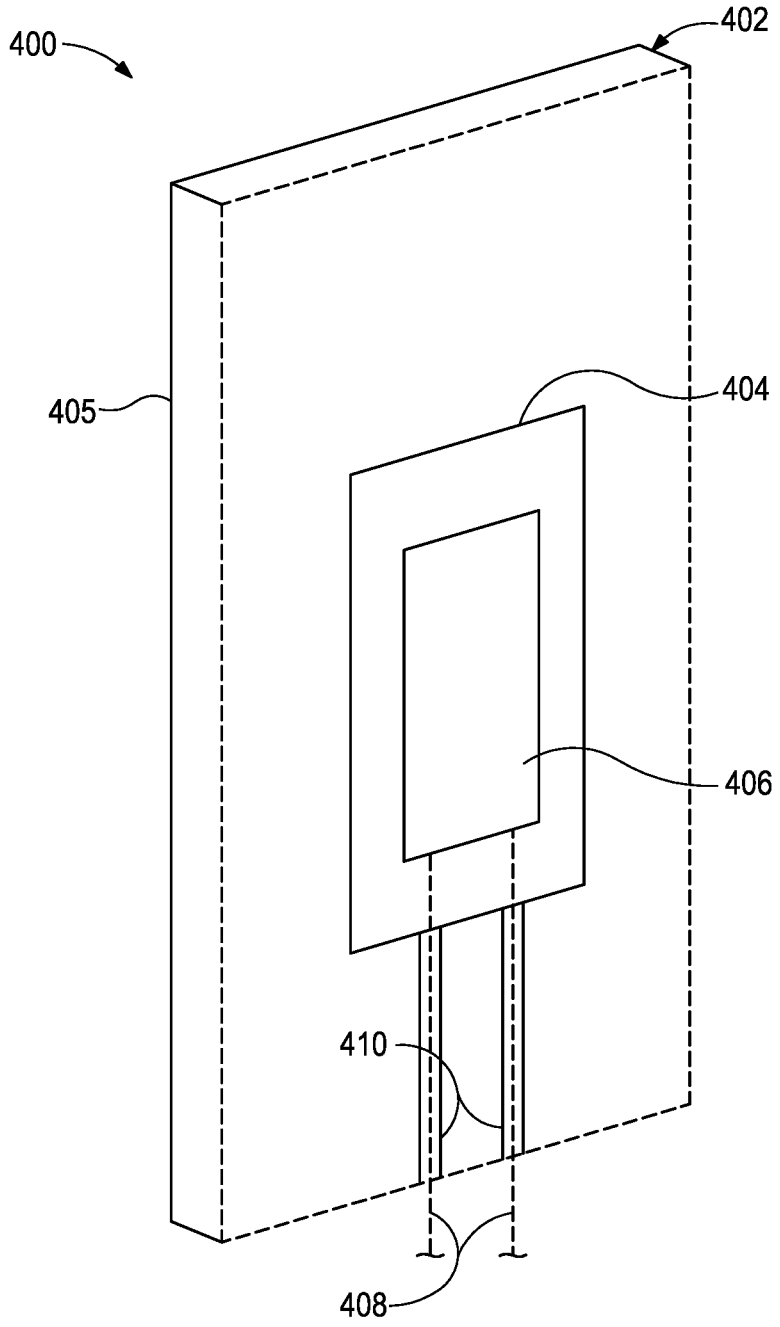
FIG. 4 is a cross-sectional view of a smart variable gauge pad, according to at least one embodiment of the present disclosure.

FIG. 4 is a cross-sectional view of another example variable gauge pad 400, according to at least one embodiment of the present disclosure. The variable gauge pad 400 may be similar in some respects to the variable gauge pad 300 of FIG. 3, and therefore may be best understood with reference thereto. For example, in some embodiments, the variable gauge pad 400 may include a solid body 402 that may be of a similar geometry and composition as the solid body 302 of FIG. 3. Accordingly, the variable gauge pad 400 may comprise a separate component part that can be removably attached to a bit body (e.g., the bit body 102 of FIG. 1), and the variable gauge pad 400 may be designed and engineered on-site to meet specific drilling and borehole requirements.

In some embodiments, as illustrated, a pocket 404 may be defined in a backside of the solid body 402 and otherwise opposite a gauge pad surface 405 of the variable gauge pad 400. The pocket 404 provides a void in the backside of the variable gauge pad 400, and one or more sensors 406 may be installed, mounted, or integrated into the pocket 404, such that the variable gauge pad 400 may be monitored in real-time during operation. The one or more sensors 406 may include, but are not limited to, one or more strain gauges, a pressure transducer, a thermocouple, an accelerometer, a vibration sensor, or any combination thereof.

The sensor(s) 406 may be communicatively coupled to the communication means of the drill bit or BHA via one or more wires 408, such that the readings of the sensor(s) 406 may be received in real-time by an operator. The one or more wires 408 may be similarly embedded or installed within one or more slots 410 further defined within the solid body 402. In other embodiments, however, the sensors 406 may be configured to communicate wirelessly to provide real-time measurements and readings.

The sensor(s) 406 may be utilized and otherwise operable during drilling operations for measuring and obtaining real-time analysis of drilling conditions, as well as the health or durability of the variable gauge pad 400 or corresponding drill bit. In embodiments where the sensor(s) 406 comprise one or more strain gauges, the sensor(s) 406 may directly measure the stress and strain assumed by the variable gauge pad 400 during drilling. In such embodiments, the strain gauge(s) may detect damage to the variable gauge pad 400, as the stress and strain may decrease rapidly if the outer surface of the variable gauge pad 400 is damaged or sheared such that it is no longer in contact with the walls of the borehole.

Accordingly, the sensor(s) 406 may be used to determine and/or detect drill bit damage or damage to the variable gauge pad 400 in real-time. Measurements or readings obtained by the sensor(s) 406 may be transmitted in real-time to a well operator for consideration, and the well operator may then intelligently manage continued drilling operations. Accordingly, the variable gauge pad 400 may be characterized as a "smart" variable gauge pad 400 that helps well operators monitor drill bit and gauge pad 400 health in real-time.

In further embodiments, monitoring the real-time conditions of the drill bit and/or the variable gauge pad 400 using the sensor(s) 406 may provide a well operator with an indication of favorable geometry, configuration, or material to be used in place of the currently installed geometry, configuration, or material of the variable gauge pad 400. In some embodiments, for example, readings from the sensor(s) 406 may be utilized in determining a real-time gauge diameter of the drill bit and corresponding bore hole. In such embodiments, any undergauging may be detected and tracked in real-time as it occurs. In these embodiments, repair or re-drilling operations may be better advised from the onset of undergauging, or may be avoided altogether due to real-time tracking. In further embodiments, the variable gauge pad 400 may be responsive, such that measurements of the sensor(s) 406 may signal for response or adjustment of one or more gauge inserts 218 (FIG. 2) and/or gauge cutters 220 (FIG. 2) of the variable gauge pad 400.

The smart variable gauge pad 400 may further be utilized in active monitoring of drilling operations and may provide real-time insights into the health of the smart variable gauge pad 400 and associated drill bit. In some embodiments, for example, the sensor(s) 406 may enable continuous or intermittent data collection, which may advise future drilling operations or track active operations using the existing tooling communication means. The ability to actively track damage or wear of the smart variable gauge pad 400 may enable damage detection as it happens, and may prevent the need to further repair operations on the drill bit or corrective drilling operations to be performed downhole. Moreover, active and real-time reporting of current gauge diameter may provide confidence in the accurate drilling of the borehole without the risk of undergauging.

Figure 5A:
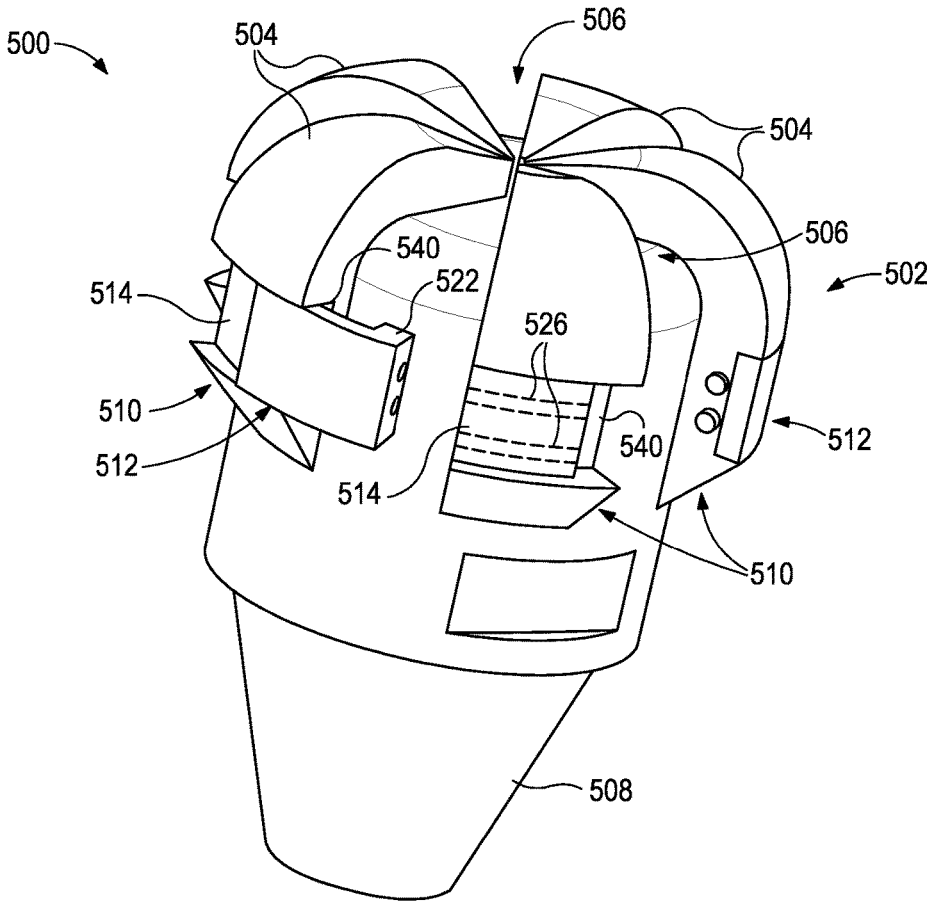
FIG. 5A is an isometric view of another example drill bit that may incorporate the principles of the present disclosure.

FIG. 5A is an isometric view of another example drill bit 500 that may incorporate the principles of the present disclosure. The drill bit 500 may be similar in some respects to the drill bit 112 of FIGS. 1 and 2, and therefore may be best understood with reference thereto. Similar to the drill bit 112, for example, the drill bit what 500 includes a bit body 502 that provides or otherwise defines one or more drill bit blades 504 separated by junk slots 506. While not shown in FIG. 5, the drill bit 500 can further include a plurality of cutting elements (e.g., cutting elements 210 of FIG. 2) fixed to the blades 504. The drill bit 500 further includes a pin 508 that defines drill pipe threads (not visible) used to releasably engage the drill bit 500 with drill pipe or a bottom-hole assembly (BHA) whereby the drill bit 500 may be rotated to drill a borehole.

Moreover, similar to the drill bit 112 of FIGS. 1 and 2, the drill bit 500 may further include one or more gauge pads 510 provided on outer radial portions of the blades 504 or the bit body 502 to contact radially adjacent portions of the drilled wellbore. In the illustrated embodiment, one or more of the gauge pads 510 may comprise or otherwise have attached thereto a variable gauge pad 512 (two shown). To be able to accommodate the variable gauge pad 512, a cutout or pocket 514 may be defined in the bit body 502, such as in the corresponding gauge pad 510. The pocket 514 may be sized to receive and seat the corresponding variable gauge pad 512.

Figure 5B:
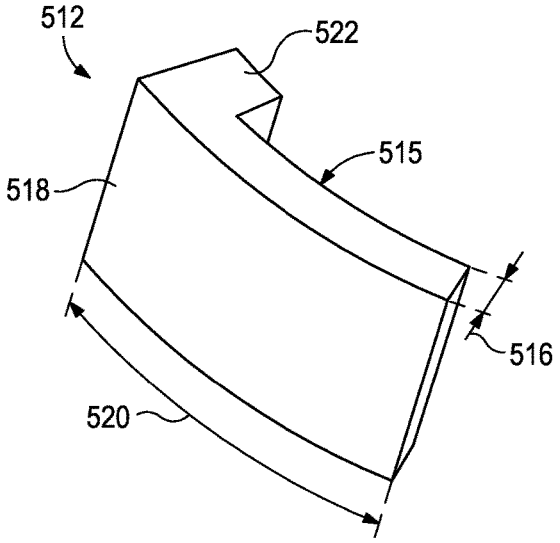
FIGS. 5B-5D are isometric views of the variable gauge pad of FIG. 5A, according to one or more embodiments.
Figure 5C:
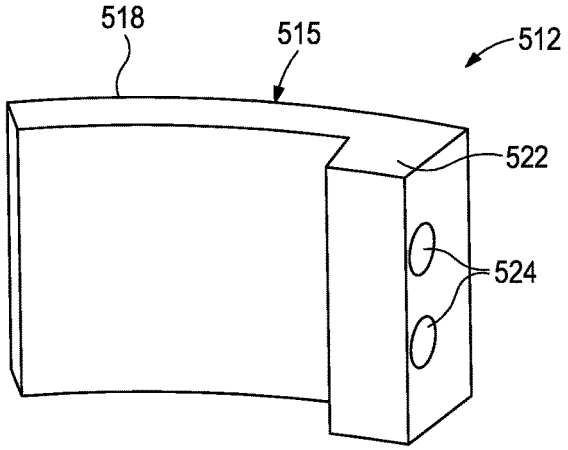

With continued reference to FIG. 5A, FIGS. 5B and 5C illustrate isometric outer and inner views, respectively, of one example of the variable gauge pad 512, according one or more embodiments of the present disclosure. Similar to the variable gauge pad 300 of FIG. 3, the variable gauge pad 512 may be characterized and otherwise referred to herein as an "on-demand" variable gauge pad 512 that comprises a separate component part that can be removably attached to the bit body 502 on site at a drilling rig. Consequently, the variable gauge pad 512 may be designed and engineered to meet specific drilling and borehole requirements.

As illustrated, the variable gauge pad 512 may define or otherwise include a solid body 515, which may exhibit a gauge depth or "thickness" 516 (FIG. 5B). The variable gauge pad 512 may also provide a gauge pad surface 518 configured to be oriented away from the bit body 502, thus constituting the outer radial surface of the variable gauge pad 512 that contacts and helps form the inner walls of the wellbore during operation. As illustrated, the gauge pad surface 518 may provide an arcuate or curved surface that exhibits an arc length 520 (FIG. 5B). The curved outer surface of the gauge pad surface 518 may match the shape of the rounded bit body 502, thus matching the outer circumference of the drill bit 500. Moreover, the arc length 520 may match the corresponding arc length of the blade 504 where the variable gauge pad 512 is to be received.

The body 515 may further provide and otherwise define a radial shoulder 522 that extends radially away from the gauge pad surface 518. The body 515, including the arcuate or curved nature of the gauge pad surface 518 and the radial shoulder 522, may be configured to be received within the pocket 514 of the drill bit 500.

The variable gauge pad 512 may also include mating mechanism similar in some respects to the mating mechanism 310 of FIG. 3, which enables the variable gauge pad 512 to be installed on or removed from the drill bit 500 (FIG. 5A) on-site during a drilling operation. In some embodiments, for example, the mating mechanism may include one or more apertures 524 (two shown in FIG. 5C) defined laterally through the radial shoulder 522 and configured to align with corresponding slots or holes 526 (shown as dashed lines in FIG. 5A) defined in the pocket 514 (FIG. 5A) when the variable gauge pad 512 is properly received within the pocket 514. The apertures 524 may form part of the mating mechanism configured to removably attach the variable gauge pad 512 to the gauge pad 510 at the pocket 514. As described below, the mating mechanism may further include one or more pins receivable through the apertures 524 to secure the variable gauge pad 510 to the drill bit 500.

With continued reference to FIGS. 5A-5C, FIG. 5D is an isometric end view of the variable gauge pad 512, according to one or more embodiments. In some embodiments, one or more of the apertures 524 defined laterally through the radial shoulder 522 may include a counter-bore 526 configured to receive an end of a pin and thereby provide a flush surface to the variable gauge pad 512.

Figure 5D:
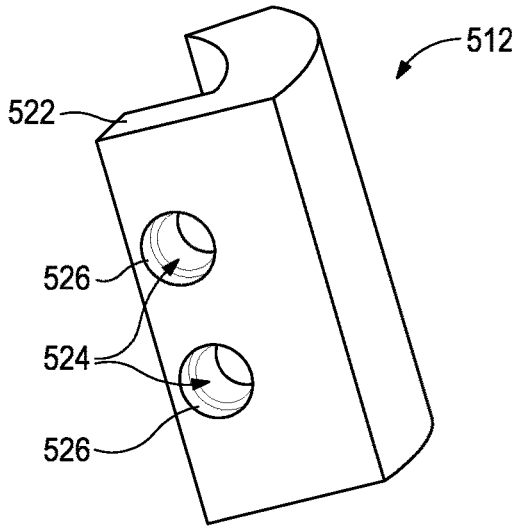
Figure 5E:
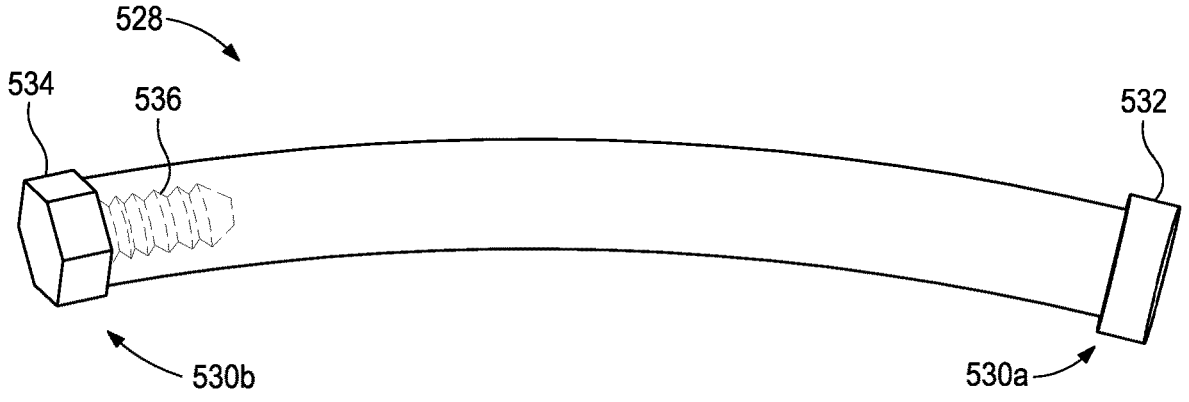
FIG. 5E is an isometric side view of an example pin that may be used to secure the variable gauge pad of FIGS. 5B-5D to the drill bit of FIG. 5A.

With continued reference to FIGS. 5A-5D, FIG. 5E is an isometric side view of an example pin 528 that may be used to secure the variable gauge pad 512 to the pocket 514 (FIG. 5A). As briefly mentioned above, the pin 528 may form part of the mating mechanism configured to removably attach the variable gauge pad 512 to the gauge pad 510. As illustrated, the pin 528 may be arcuate and otherwise exhibit a curved shape that matches the curved or arcuate shape of the variable gauge pad 512 (FIGS. 5B-5D). Moreover, the pin 528 may be configured to be received within one of the apertures 524 (FIGS. 5C-5D) defined in the gauge pad 512. To mechanically fasten the variable gauge pad 512 to the corresponding pocket 514, the pin 528 may be inserted through the aperture 524 and advanced into a corresponding and axially-aligned hole 526 defined in the pocket 514.

The pin 528 may have opposing first and second ends 530*a* and 530*b*. At the first end 530*a*, the pin 528 may include a head cap 532 sized to be received within a corresponding counter-bore 526 (FIG. 5D) of an aperture 524. At the second end 530*b*, the pin 528 may provide a threaded fastener 534 configured to be received within a corresponding threaded aperture 538 defined at the second and 530*b*. Once the pin 528 is extended through the axially-aligned aperture 524 and hole 526, the threaded fastener 534 may be threaded to the threaded aperture 538 to secure the pin 528 in place.

Referring again to FIG. 5A, with continued reference to FIGS. 5B-5E, to removably attach the variable gauge pad 512 to the drill bit 500 of the pocket 514, the variable gauge pad 512 may be received laterally within the pocket 514 (e.g., slid laterally into the pocket 514) until the radial shoulder 522 engages and otherwise is received within a corresponding radial recess 540. Once the radial shoulder 522 is properly seated against the radial recess 540, one or more pins 528 may be received within the coaxially aligned apertures 524 and holes 526. The head cap 532 of the pin 528 may be advanced until being received within the counter-bore 526. Upon being received within the counter-bore 526 the second end 530*b* of the pin 528 may extend out of the hole 526, thereby providing an exposed end capable of receiving the threaded fastener 534. The threadably-mated connection between the threaded fastener 534 and the pin 528 may prevent removal of the pin 528 from the variable gauge pad 512 during operation. In some embodiments, the pin 528 may be replaced by a straight fastener, such as a bolt, which may be similarly inserted into the coaxially aligned apertures 524 and holes 526. In these embodiments, the holes 526 may include a threaded connection corresponding to a threaded connection on the straight fastener. In further embodiments, the pin 528 may be replaced by a straight pin, such as the main pin 312 or secondary pins 314 of FIG. 3.

In some embodiments, following the initial mating of the variable gauge pad 512 to the drill bit using the pins 528, or alternate straight pins as described above, the variable gauge pad 512 may be brazed, welded, fastened, or locked into place for use in drilling operations.

Figure 6:
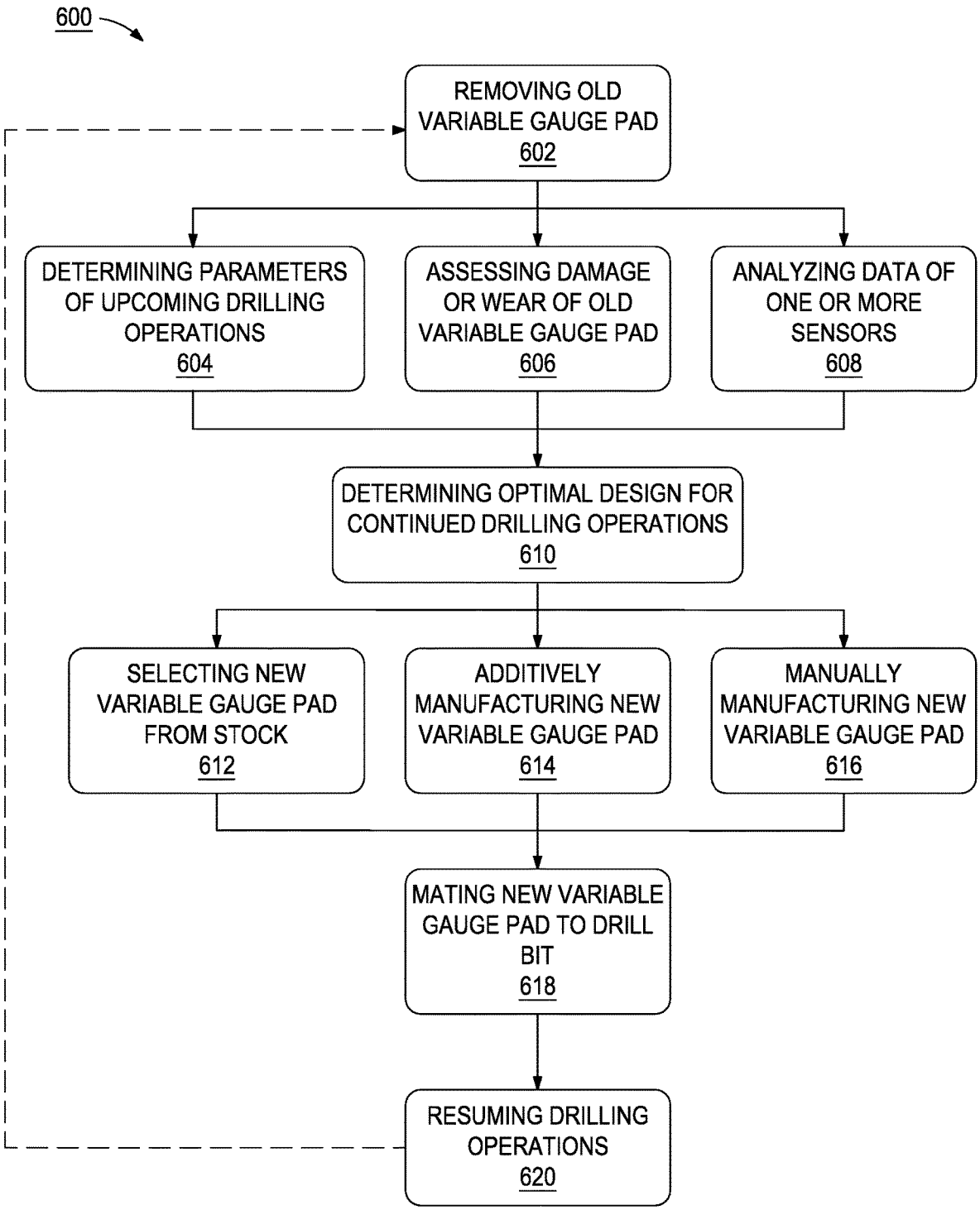
FIG. 6 is a flowchart of an example method for on-demand production of a variable gauge pad.

FIG. 6 is a flowchart of an example method 600 for on-demand production of a variable gauge pad (e.g., the variable gauge pads 300 or 500 of FIGS. 3 and 5A-5D), according to one or more embodiments. The method 600 may begin at 602 with removal of a used variable gauge pad from a drill bit (e.g., the drill bit 112, 500 of FIGS. 1-2 and 5A). In some embodiments, the drill bit is removed from the wellbore as the used variable gauge pad is damaged or showing signs of wear. In alternate embodiments, however, the drill bit is removed from the wellbore in preparation for an anticipated change in subterranean environment or drilling operation. One or more of the previously installed variable gauge pads may be removed from the drill bit via cutting, debrazing, dewelding, unfastening, or any other suitable means of disengaging the mating mechanism (e.g., the mating mechanism 310 of FIG. 3). The one or more used variable gauge pads removed at 602 may be discarded or recycled if worn or damaged, or retained for later use if durability has been maintained or repair is possible.

The method 600 may further include determining parameters for upcoming drilling operations or "future drilling", as at 604. The upcoming drilling operations to be performed after drill bit repair, replacement, or retooling may require a particular gauge pad orientation, geometry, or configuration for optimal drilling. In some embodiments, the borehole may be at the desired depth and may require a transition to a horizontal drilling operation. In these embodiments, the drilling operation may require shorter gauge lengths (e.g., the gauge length 304 of FIG. 3) such that the drill bit is better suited for steering and directional changes as the borehole is transitioned from vertical to horizontal. In further embodiments, seismic scans or geological surveys may indicate a change of composition of the downhole rock which may require a change of geometry, configuration, or hardfacing material of the new variable gauge pad.

The method 600 may further include assessment of damage or wear of the used variable gauge pads, as at 606. In embodiments involving damage of the drill bit or used variable gauge pads, analysis of the damage may inform improvements to the new variable gauge pads. In some embodiments, the used variable gauge pad may exhibit uneven wear, such that a new design with reinforcement or uneven shaping may be employed to reduce future wear under similar conditions. In further embodiments, the hardfacing or cutting configurations may be undergoing damage at a faster rate than expected. In these embodiments, new variable gauge pads may benefit from alterations to the design or material used for the hardfacing or cutting mechanisms.

The method 600 may additionally include analysis of data or readings obtained by one or more sensors included in the variable gauge pad, as at 608. In such embodiments, the used variable gauge pads may be "smart" variable gauge pads (e.g., the smart variable gauge pad 400 of FIG. 4). Based on the data or readings obtained from the sensor(s) (e.g., the one or more sensors 406 of FIG. 4), a well operator may selectively replace one or more of the used variable gauge pads. In these embodiments, the sensor(s) are embedded within the used variable gauge pads. In alternate embodiments, however, the sensor(s) may be embedded or otherwise included in the drill bit or the associated BHA. The sensor(s) may provide insight into the nature or source of damage to the drill bit or the used variable gauge pads, such that new variable gauge pads may be designed in accordance with active drilling conditions.

The method 600 may further include determining an optimal design for the gauge pads for continued drilling operations, as at 610. The determination of the optimal design may incorporate the parameters determined at 604, the damage assessment at 606, and the data analysis at 608, such that the design is informed by future conditions, historical data, and active assessment of a working tool. In some embodiments, the optimal design determined at 610 may be limited to one or more designs previously generated or manufactured. The optimal design determined at 610 may be utilized for selection of a new variable gauge pad from available stock at a worksite, as at 612. In these embodiments, the new variable gauge pads best suited for the active and future drilling operations may be selected for installation on the drill bit, such that the drill bit may be repaired or updated for optimal operation. Moreover, in these embodiments, the selected new variable gauge pad may be a smart variable gauge pad as previously discussed.

In alternate embodiments, however, an operator at a worksite may utilize the information from steps 604-608 to engineer a new design for a variable gauge pad that satisfies the needs of future drilling operations, as at 610. This new design may be additively manufactured (i.e., 3D printed) on-site, as at 614, to construct a new variable gauge pad. The additive manufacturing method may include, but is not limited to, material extrusion, powder bed fusion, sheet lamination, binder jetting, or directed energy deposition. Following design of a new variable gauge pad on an operator device, an additive manufacturing machine may be utilized for construction of the new variable gauge pad from a digital output. In a further embodiment, however, the method 600 may further include manually manufacturing of a new variable gauge pad, as at 616. An operator or toolmaker may utilize the determination previously made at 610 to manually manufacture the new variable gauge pad using available tooling and materials.

Once one or more new variable gauge pads have been selected or manufactured, the new variable gauge pads may be installed, as at 618. The new variable gauge pads may be mated to the drill bit via the previously discussed mating mechanisms, and may be further mated via welding, brazing, mechanically fastening, or any other locking mechanism for securing the new gauge pads to the bit body. In some embodiments, mating the variable gauge pads to the bit body may further include attaching the one or more sensors of a smart variable gauge pad to the tool communication means of the drill bit or associated BHA.

Following the mating of the new variable gauge pad(s) to the bit body, the method 600 may further include resuming drilling operations, as at 620. The drilling operations may continue with the newly installed variable gauge pads until damage or wear is detected, or if future drilling operations require alteration of the new variable gauge pads. As such, the method 600 may return to 602 with the removal of the used variable gauge pads, and the method 600 may continue to loop during active drilling operations until total depth of the wellbore is reached.

The method 600 may enable replacement or repair of one or more variable gauge pads on a drill bit at the drilling site without the need for extensive downtime or expensive replacement drill bits. The method 600 may further enable the utilization of real-time data, historical damage information, and forecasted drilling insights to design and manufacture an optimal variable gauge pad for current or future drilling operations. The method 600 may enable rapid prototyping or manufacturing via additive manufacturing on-site. The method 600 may increase the lifetime of fixed cutter drill bits while further optimizing active drilling operations with a variety of analyzed factors.

Embodiments disclosed herein include:

A. A method of drilling a wellbore, comprising: rotating a drill bit positioned at a distal end of a drill string and thereby drilling a portion of the wellbore, the drill bit including a bit body and one or more variable gauge pads removably coupled to the bit body, retrieving the drill bit to a well surface at a well site and removing a used variable gauge pad of the one or more variable gauge pads from the bit body at the well site, coupling a new variable gauge pad to the bit body in place of the used variable gauge pad, and extending the drill bit with the new variable gauge pad back into the wellbore and resuming drilling operations with the drill bit.

B. A drilling system, comprising: a drilling rig, a drill string extending from the drilling rig and into a wellbore, a drill bit arranged at a distal end of the drill string and including a bit body that defines pocket on an outer radial portion of the bit body, and a variable gauge pad sized to be received within the pocket and removably coupled to the bit body, the variable gauge pad including: a solid body providing a gauge pad surface oriented away from the bit body when coupled to the bit body, and a mating mechanism for removably coupling the solid body to the bit body at the pocket.

C. A drill bit comprising: a bit body, and one or more variable gauge pads removably coupled to an outer radial portion of the bit body, each variable gauge pad including: a solid body providing a gauge pad surface oriented away from the bit body when coupled to the bit body, a mating mechanism provided on a surface opposite the gauge pad surface and configured to removably couple the solid body to the bit body, a pocket defined in a backside of the solid body, and one or more sensors mounted in the pocket and operable to obtain real-time readings and data of the variable gauge pad during drilling, wherein the one or more sensors are communicable with a well operator during drilling to convey the readings and data in real time to an operator.

Each of embodiments A through C may have one or more of the following additional elements in any combination: Element 1: wherein the used variable gauge pad is removably coupled to the bit body with a mating mechanism, and wherein removing the used variable gauge pad from the bit body comprises disengaging the mating mechanism at the well site. Element 2: wherein coupling the new variable gauge pad to the bit body is preceded by: assessing damage assumed by the used variable gauge pad during drilling, and selecting the new variable gauge pad based on the damage assumed by the used variable gauge pad. Element 3: wherein coupling the new variable gauge pad to the bit body is preceded by: determining parameters for future drilling, and selecting the new variable gauge pad based on the parameters for future drilling. Element 4: wherein one or more sensors are embedded within the used variable gauge pad, and wherein coupling the new variable gauge pad to the bit body is preceded by: analyzing data or readings obtained by the one or more sensors while drilling the wellbore, and selecting the new variable gauge pad based on the data or readings. Element 5: wherein coupling the new variable gauge pad to the bit body is preceded by 3D printing the new variable gauge pad on-site. Element 6: wherein the new variable gauge pad includes a solid body providing a gauge pad surface oriented away from the bit body when coupled to the bit body, a radial shoulder extending away from the gauge pad surface, and a mating mechanism for removably coupling the solid body to the bit body at the pocket, and wherein coupling the new variable gauge pad to the bit body comprises: receiving the new variable gauge pad laterally within a pocket defined in the bit body, advancing the new variable gauge pad until the radial shoulder engages a radial recess defined in the pocket, and securing the new variable gauge pad to the bit body with the mating mechanism.

Element 7: wherein the mating mechanism includes a main pin extending laterally from the radial shoulder, and one or more secondary pins vertically offset from the main pin and extending laterally from the radial shoulder, and wherein receiving the new variable gauge pad laterally within the pocket comprises receiving the main pin and the one or more secondary pins within corresponding holes defined in the bit body at the pocket. Element 8: wherein the mating mechanism includes a hole defined in the pocket, an aperture defined laterally through the radial shoulder and alignable with the hole, and a pin receivable through the aperture aligned with the hole, and wherein securing the new variable gauge pad to the bit body with the mating mechanism comprises: extending the pin through the aperture and the hole when the new variable gauge pad is received within the pocket, advancing the pin through the aperture and the hole until an end of the pin extends out of the hole, and threading a threaded fastener to the end of the pin to secure the pin within aperture and the hole and thereby securing the new variable gauge pad to the bit body. Element 9: wherein the gauge pad surface includes at least one of one or more gauge inserts and one or more gauge cutters. Element 10: wherein the solid body provides a radial shoulder extending away from the gauge pad surface and the mating mechanism includes: a main pin extending laterally from the radial shoulder, and one or more secondary pins vertically offset from the main pin and extending laterally from the radial shoulder, wherein the main pin and the one or more secondary pins are sized to be received within corresponding holes defined in the bit body at the pocket.

Element 11: wherein at least one of the one or more variable gauge pads further includes: a pocket defined in a backside of the solid body, and one or more sensors mounted in the pocket and operable to obtain real-time readings and data of the at least one of the one or more variable gauge pads during operation, wherein the one or more sensors are in communication with the drilling rig such that the real-time readings and data are received in real-time by an operator. Element 12: wherein the one or more sensors are selected from the group consisting of one or more strain gauges, a pressure transducer, a thermocouple, an accelerometer, a vibration sensor, and any combination thereof. Element 13: wherein the real-time readings and data are indicative of a real-time gauge diameter of the drill bit and the wellbore. Element 14: wherein the solid body provides a radial shoulder extending away from the gauge pad surface and the mating mechanism includes: a hole defined in the pocket; an aperture defined laterally through the radial shoulder and alignable with the hole when the variable gauge pad is received within the pocket, and a pin receivable through the aperture aligned with the hole to secure the variable gauge pad to the drill bit. Element 15: wherein the gauge pad surface exhibits a curved outer surface that matches a curvature of the bit body. Element 16: wherein a head cap is provided at one end of the pin, and the head cap is sized to be received within a counter-bore defined in the aperture. Element 17: wherein the mating mechanism further includes a threaded fastener configured to be threaded to an end of the pin after the pin is advanced through the aperture aligned with the hole.

By way of non-limiting example, exemplary combinations applicable to A through C include: Element 6 with Element 7; Element 6 with Element 8; Element 11 with Element 12; Element 11 with Element 13; Element 14 with Element 15; Element 14 with Element 16; and Element 14 with Element 17.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation used herein are merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A method of drilling a wellbore, comprising:

rotating a drill bit positioned at a distal end of a drill string and thereby drilling a portion of the wellbore, the drill bit including a bit body and one or more variable gauge pads removably coupled to the bit body;

retrieving the drill bit to a well surface at a well site;

removing a used variable gauge pad of the one or more variable gauge pads from the bit body at the well site and thereby exposing a pocket defined in the bit body, the pocket including a radial recess provided at a lateral end of the pocket;

selecting a new variable gauge pad to be secured to the bit body in place of the used variable gauge pad, the new variable gauge pad including:

a solid body providing a gauge pad surface oriented away from the bit body when coupled to the bit body; and a radial shoulder provided at a lateral end of the solid body and extending away from the gauge pad surface;

advancing the new variable gauge pad laterally into the pocket until the radial shoulder engages the radial recess; and extending the drill bit with the new variable gauge pad back into the wellbore and resuming drilling operations with the drill bit.

2. The method of claim 1, wherein the used variable gauge pad is removably coupled to the bit body with a mating mechanism, and wherein removing the used variable gauge pad from the bit body comprises disengaging the mating mechanism at the well site.

3. The method of claim 1, wherein selecting the new variable gauge pad is preceded by:

assessing damage assumed by the used variable gauge pad during drilling; and selecting the new variable gauge pad based on the damage assumed by the used variable gauge pad, wherein the new variable gauge pad includes one or more changes to a design or a material corresponding to the assumed damage.

4. The method of claim 1, wherein selecting the new variable gauge pad is preceded by:

determining parameters for future drilling; and selecting the new variable gauge pad based on the parameters for future drilling.

5. The method of claim 1, wherein one or more sensors are embedded within the used variable gauge pad, and wherein selecting the new variable gauge pad is preceded by:

analyzing data or readings obtained by the one or more sensors while drilling the wellbore; and selecting the new variable gauge pad based on the data or readings.

6. The method of claim 1, wherein selecting the new variable gauge pad is preceded by 3D printing the new variable gauge pad on-site.

7. The method of claim 1, wherein the new variable gauge pad further includes a mating mechanism for removably coupling the solid body to the bit body at the pocket, the method further comprising coupling the new variable gauge pad to the bit body by securing the new variable gauge pad to the bit body with the mating mechanism.

8. The method of claim 7, wherein the mating mechanism includes a main pin extending laterally from the radial shoulder, and one or more secondary pins vertically offset from the main pin and extending laterally from the radial shoulder, and wherein receiving the new variable gauge pad laterally within the pocket comprises receiving the main pin and the one or more secondary pins within corresponding holes defined in the bit body at the pocket.

9. The method of claim 7, wherein the mating mechanism includes a hole defined in the pocket, an aperture defined laterally through the radial shoulder and alignable with the hole, and a pin receivable through the aperture aligned with the hole, and wherein securing the new variable gauge pad to the bit body with the mating mechanism comprises:

extending the pin through the aperture and the hole when the new variable gauge pad is received within the pocket;

advancing the pin through the aperture and the hole until an end of the pin extends out of the hole; and threading a threaded fastener to the end of the pin to secure the pin within aperture and the hole and thereby securing the new variable gauge pad to the bit body.

10. A drilling system, comprising:

a drilling rig;

a drill string extending from the drilling rig and into a wellbore;

a drill bit arranged at a distal end of the drill string and including a bit body that defines a pocket on an outer radial portion of the bit body, the pocket including a radial recess provided at a lateral end of the pocket; and a variable gauge pad sized to be received within the pocket and removably coupled to the bit body, the variable gauge pad including:

a solid body providing a gauge pad surface oriented away from the bit body when coupled to the bit body;

a radial shoulder provided at a lateral end of the solid body and extending away from the gauge pad surface, the new variable gauge pad being advanceable laterally into the pocket until the radial shoulder engages the radial recess; and a mating mechanism for removably coupling the solid body to the bit body at the pocket.

11. The drilling system of claim 10, wherein the gauge pad surface includes at least one of one or more gauge inserts and one or more gauge cutters.

12. The drilling system of claim 10, wherein the mating mechanism includes:

a main pin extending laterally from the radial shoulder; and one or more secondary pins vertically offset from the main pin and extending laterally from the radial shoulder, wherein the main pin and the one or more secondary pins are sized to be received within corresponding holes defined in the bit body at the pocket.

13. The drilling system of claim 10, wherein at least one of the one or more variable gauge pads further includes:

a pocket defined in a backside of the solid body; and one or more sensors mounted in the pocket and operable to obtain real-time readings and data of the at least one of the one or more variable gauge pads during operation, wherein the one or more sensors are in communication with the drilling rig such that the real-time readings and data are received in real-time by an operator.

14. The drilling system of claim 13, wherein the one or more sensors are selected from the group consisting of one or more strain gauges, a pressure transducer, a thermocouple, an accelerometer, a vibration sensor, and any combination thereof.

15. The drilling system of claim 13, wherein the real-time readings and data are indicative of a real-time gauge diameter of the drill bit and the wellbore.

16. The drilling system of claim 10, wherein the mating mechanism includes:

a hole defined in the pocket;

an aperture defined laterally through the radial shoulder and alignable with the hole when the variable gauge pad is received within the pocket; and a pin receivable through the aperture aligned with the hole to secure the variable gauge pad to the drill bit.

17. The drilling system of claim 16, wherein the gauge pad surface exhibits a curved outer surface that matches a curvature of the bit body.

18. The drilling system of claim 16, wherein a head cap is provided at one end of the pin, and the head cap is sized to be received within a counter-bore defined in the aperture.

19. The drilling system of claim 16, wherein the mating mechanism further includes a threaded fastener configured to be threaded to an end of the pin after the pin is advanced through the aperture aligned with the hole.

20. A drill bit comprising:

a bit body; and one or more variable gauge pads removably coupled to an outer radial portion of the bit body, each variable gauge pad including:

a solid body providing a gauge pad surface oriented away from the bit body when coupled to the bit body, a mating mechanism provided on a surface opposite the gauge pad surface and configured to removably couple the solid body to the bit body, a pocket defined in a backside of the solid body, and one or more sensors mounted in the pocket and operable to obtain real-time readings and data of the variable gauge pad during drilling, wherein the one or more sensors are communicable with a well operator during drilling to convey the readings and data in real time to an operator.

* * * * *